US012404740B2

(12) United States Patent
Obaidi et al.

(10) Patent No.: US 12,404,740 B2
(45) Date of Patent: Sep. 2, 2025

(54) SACRIFICIAL TOOL FOR PLUGGING AND ABANDONING A WELLBORE AND METHODS THEREOF

(71) Applicant: SAUDI ARABIAN OIL COMPANY, Dhahran (SA)

(72) Inventors: Ibrahim A. Obaidi, Dhahran (SA); Nawaf S. Shammari, Dhahran (SA); Abdulrahman K. Assiri, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 13 days.

(21) Appl. No.: 18/181,496

(22) Filed: Mar. 9, 2023

(65) Prior Publication Data

US 2024/0301765 A1 Sep. 12, 2024

(51) Int. Cl.
*E21B 31/18* (2006.01)
*E21B 33/14* (2006.01)
*E21B 47/10* (2012.01)

(52) U.S. Cl.
CPC ..... *E21B 33/14* (2013.01); *E21B 31/18* (2013.01); *E21B 47/10* (2013.01)

(58) Field of Classification Search
CPC ..... E21B 31/18; E21B 33/14
USPC ..... 166/250.01
See application file for complete search history.

(56) References Cited

U.S. PATENT DOCUMENTS

| | | | | |
|---|---|---|---|---|
| 6,739,398 | B1 * | 5/2004 | Yokley | E21B 23/04 166/123 |
| 10,597,986 | B2 * | 3/2020 | Burke | E21B 43/10 |
| 11,519,244 | B2 * | 12/2022 | Turley | E21B 43/10 |
| 2014/0000911 | A1 * | 1/2014 | Gorrara | E21B 19/16 166/207 |
| 2021/0115757 | A1 * | 4/2021 | Murray | E21B 33/14 |

* cited by examiner

*Primary Examiner* — William D Hutton, Jr.
*Assistant Examiner* — Ashish K Varma
(74) *Attorney, Agent, or Firm* — Vorys, Sater, Seymour and Pease LLP

(57) ABSTRACT

A method includes conveying a sacrificial tool into a wellbore on a conveyance, the wellbore penetrating one or more subterranean formations and the sacrificial tool including an overshot fishing tool, a tubing operatively coupled to and extending from the overshot fishing tool, and a liner hanger arranged at an upper end of the tubing. An uphole end of a downhole tool is received within with the overshot fishing tool, the downhole tool being stuck in the wellbore adjacent the one or more subterranean formations. The uphole end of the downhole tool is sealingly engaged, and a cement is subsequently circulated through the sacrificial tool and the downhole tool and discharged into an annulus defined between the downhole tool and an inner wall of the wellbore.

15 Claims, 5 Drawing Sheets

SACRIFICIAL TOOL FOR PLUGGING AND ABANDONING A WELLBORE AND METHODS THEREOF

FIELD OF THE DISCLOSURE

The present disclosure relates generally to tools used in oil and gas wells. More particularly, the present disclosure relates to downhole tools that may be run into a wellbore and used to help assist in wellbore isolation, and systems and methods pertaining to the same. Still, more particularly, the present disclosure relates to a sacrificial tool and method for isolating subterranean reservoirs.

BACKGROUND OF THE DISCLOSURE

When a well reaches the end of its lifetime, it is often permanently plugged and abandoned (P & A) by placing one or more cement plugs in the wellbore to isolate undesired reservoirs or production zones. To help form the cement plug, a bridge plug is typically set within the wellbore downhole from the undesired reservoir or production zone, and a cement slurry is then pumped downhole and discharged on top of the bridge plug. The cement slurry is pumped until a column of cement or "cement plug" is formed within the wellbore and extends across and otherwise surpasses the undesired reservoirs or production zones.

In the event a downhole tool is stuck within the wellbore, however, forming a cement plug in the wellbore may be difficult, if not possible. In some cases, for instance, a bottom hole assembly (BHA) may be stuck within the wellbore and extend across multiple undesired reservoirs or production zones that need to be plugged. In such cases, attempts to free the stuck BHA may not be possible, and the alternative option might be to sidetrack the wellbore. Prior to drilling the sidetrack wellbore, the conveyance connected to the BHA (e.g., drill pipe) is first cut and cement is then pumped to plug the wellbore with the BHA in place. However, attempting to pump cement across multiple reservoirs with the BHA in place, and utilizing conventional balanced cement plug methods, may not be possible since the BHA will largely prevent accessibility. Moreover, squeezing cement across the undesired reservoirs or production zones to be plugged may not achieve the required isolation since the cement would likely be squeezed into the highest permeable zone.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method may include conveying a sacrificial tool into a wellbore on a conveyance, the wellbore penetrating one or more subterranean formations and the sacrificial tool including an overshot fishing tool, a tubing operatively coupled to and extending from the overshot fishing tool, and a liner hanger arranged at an upper end of the tubing. The method may further include receiving an uphole end of a downhole tool within with the overshot fishing tool, wherein the downhole tool is stuck in the wellbore adjacent the one or more subterranean formations, sealingly engaging the uphole end of the downhole tool, and circulating a cement through the sacrificial tool and the downhole tool and discharging the cement into an annulus defined between the downhole tool and an inner wall of the wellbore.

According to another embodiment consistent with the present disclosure, a sacrificial tool for plugging and abandoning a wellbore may include an overshot fishing tool configured to locate and sealingly engage an uphole end of a downhole tool stuck within the wellbore, the wellbore penetrating one or more subterranean formations, a tubing operatively coupled to and extending from the overshot fishing tool, and a liner hanger arranged at an upper end of the tubing. Cement pumped to the sacrificial tool via a conveyance is conveyed to the downhole tool and discharged from the downhole tool into an annulus defined between the downhole tool and an inner wall of the wellbore to isolate the one or more subterranean formations.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
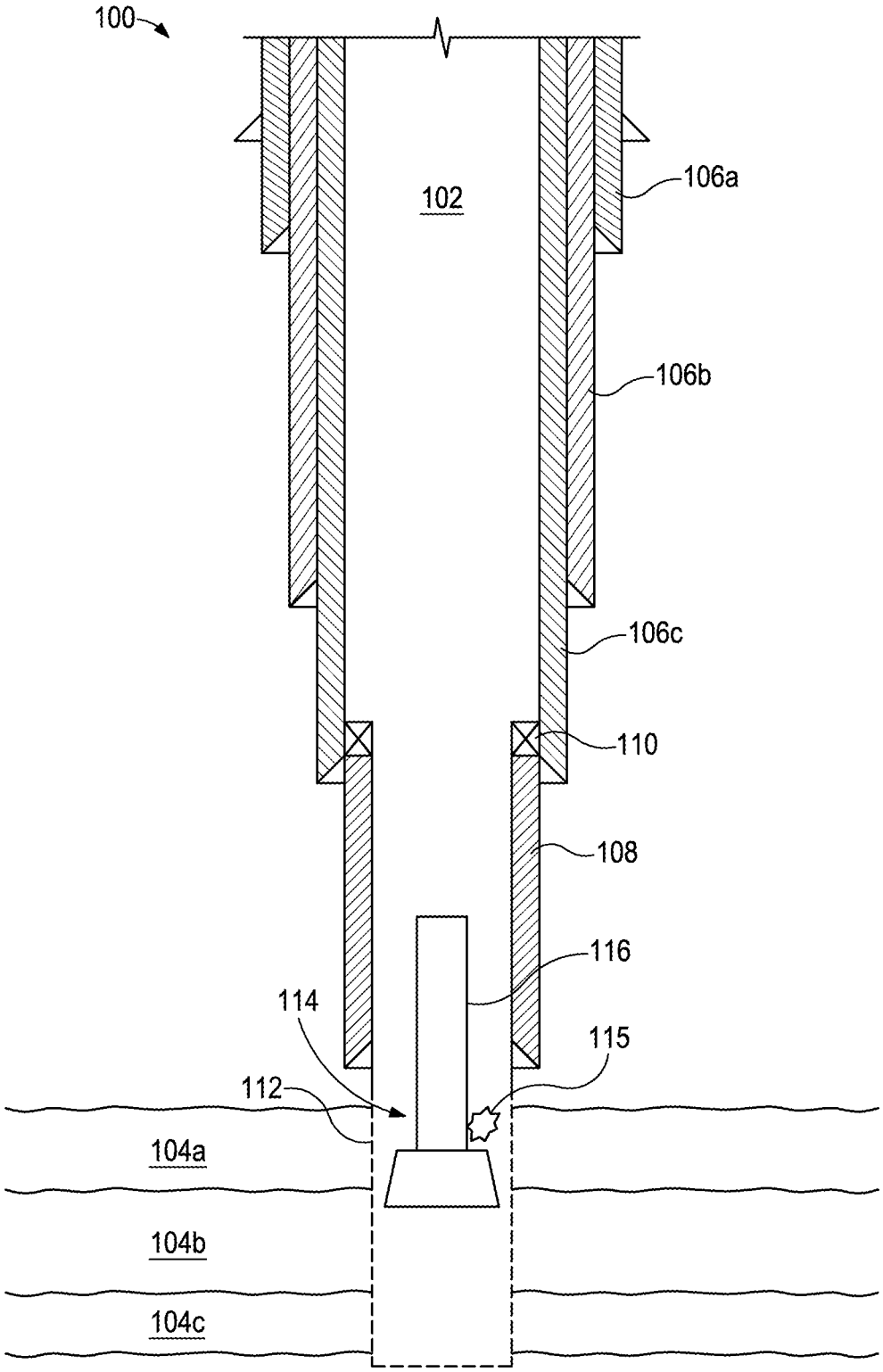
FIG. 1 depicts a schematic view of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a sacrificial downhole tools that may be run into a wellbore to help assist in wellbore plug and abandonment operations. As disclosed herein, proper and required cement isolation of undesired subterranean formations can be achieved through the use of a sacrificial tool that includes an overshot fishing tool used to engage and establish circulation through a stuck downhole tool that may be arranged adjacent the undesired subterranean formations. Once circulation through the stuck downhole tool 114 is established, a liner hanger included in the sacrificial tool can be set and cement can then be pumped down through the downhole tool and displaced into the surrounding annulus. The overshot fishing tool and the stuck downhole tool 114 are left within the wellbore as the cement cures to achieve proper reservoir isolation FIG. 1 depicts a schematic view of an example well system 100 that may incorporate the principles of the present disclosure. As illustrated, the well system 100 includes a wellbore 102 drilled into the Earth's surface and penetrating one or more subterranean formations, shown as a first formation 104*a*, a second formation 104*b*, and a third formation 104*c*. The formations 104*a-c* may be hydrocarbon-bearing formations, but could alternatively be water-bearing formations. While three formations 104*a-c* are shown in FIG. 1, more or less than three formations 104*a-c* may be present in the well system 100.

As the wellbore 102 is drilled, portions of the wellbore 102 may be progressively lined with strings of casing or wellbore liner. More specifically, a first string of casing 106*a*, alternately referred to as "surface casing," may extend from the well surface. One or more strings of intermediate casing 106*b* (one shown) may be concentrically arranged within the first string of casing 106*a* and extend from the well surface and past the distal end of the first string of casing 106*a*. A last string of casing 106*c* may extend from the well surface and past the string(s) of intermediate casing 106*b*. Each string of casing 106*a-c* may be cemented in place and help prevent collapse of the wellbore 102 and the influx of subterranean fluids except from predetermined wellbore locations.

The well system 100 may further include a liner 108 secured to and extending from the last string of casing 106*c*. The liner 108 may be secured to the casing 106*c* using a liner hanger 110, which include slips and one or more wellbore isolation devices or "packers". Similar to the strings of casing 106*a-c*, the liner 108 may be cemented in place. An open hole 112 section of the wellbore 102 extends past the liner 108 and penetrates the formations 104*a-c*.

For a variety of reasons, it may be desired to plug and abandon (P & A) the wellbore 102 to ensure that strata, particularly freshwater aquifers, are adequately isolated from formation fluids that may emanate from the subterranean formations 104*a-c*. The P & A process essentially entails depositing a column of cement in the wellbore 102 that spans the formations 104*a-c* and thereby prevents formation fluids from migrating into the wellbore 102 and potentially flowing uphole. Ideally, the wellbore 102 is free and unobstructed from any downhole obstructions or tools that may span or otherwise be located adjacent the formations 104*a-c*. In such cases, a cement slurry can be pumped downhole and progressively deposited in the wellbore 102 until a column of cement forms and spans the formations 104*a-c*. The solidified cement is sometimes referred to as a "cement plug".

In some cases, however, a downhole tool 114 may be stuck 115 in the wellbore 102 adjacent one or more of the formations 104*a-c*, thus making it difficult to properly place (form) the cement plug. The downhole tool 114 may become stuck 115 in the wellbore 102 as a result of numerous actions or mishaps that occur downhole and have no bearing on the principles of the present disclosure. The downhole tool 114 may comprise, for example, a bottom hole assembly (BHA) for a drilling operation, or a completion string that spans all or a portion of the formations 104*a-c*, but could alternatively comprise other types of downhole tools, such as heavy weight drill pipe, drill pipe, or any type of downhole tubular potentially caught with an overshot.

The downhole tool 114 may be connected to or form part of a downhole tubular 116 configured to convey the downhole tool 114 into the wellbore 102 and capable of conveying fluids from the well surface to the downhole tool 114. The downhole tubular 116 may form part of a bottom hole assembly (BHA) and may include, but is not limited to, drill pipe and production tubing. Upon determining that the downhole tool 114 is stuck 115 within the wellbore, the downhole tubular 116 may be severed or cut, leaving the downhole tool 114 and a severed portion of the downhole tubular 116 within the wellbore 102. The stuck downhole tool 114 and severed downhole tubular 116 can be referred to as a "fish".

According to embodiments of the present disclosure, proper and required cement isolation of the formations 104*a-c* may be achieved through the use of a sacrificial tool that includes an overshot fishing tool used to engage and establish circulation through the stuck downhole tool 114. Once the overshot fishing tool is properly engaged with the stuck downhole tool 114, circulation through the stuck downhole tool 114 is established, following which a liner hanger included in the sacrificial tool can be set and cement can then be pumped down through the downhole tool 114 and displaced enough to have the cement extend to at or level with the liner hanger. The overshot fishing tool and the stuck downhole tool 114 are left within the wellbore as the cement cures to achieve proper reservoir isolation.

Figure 2:
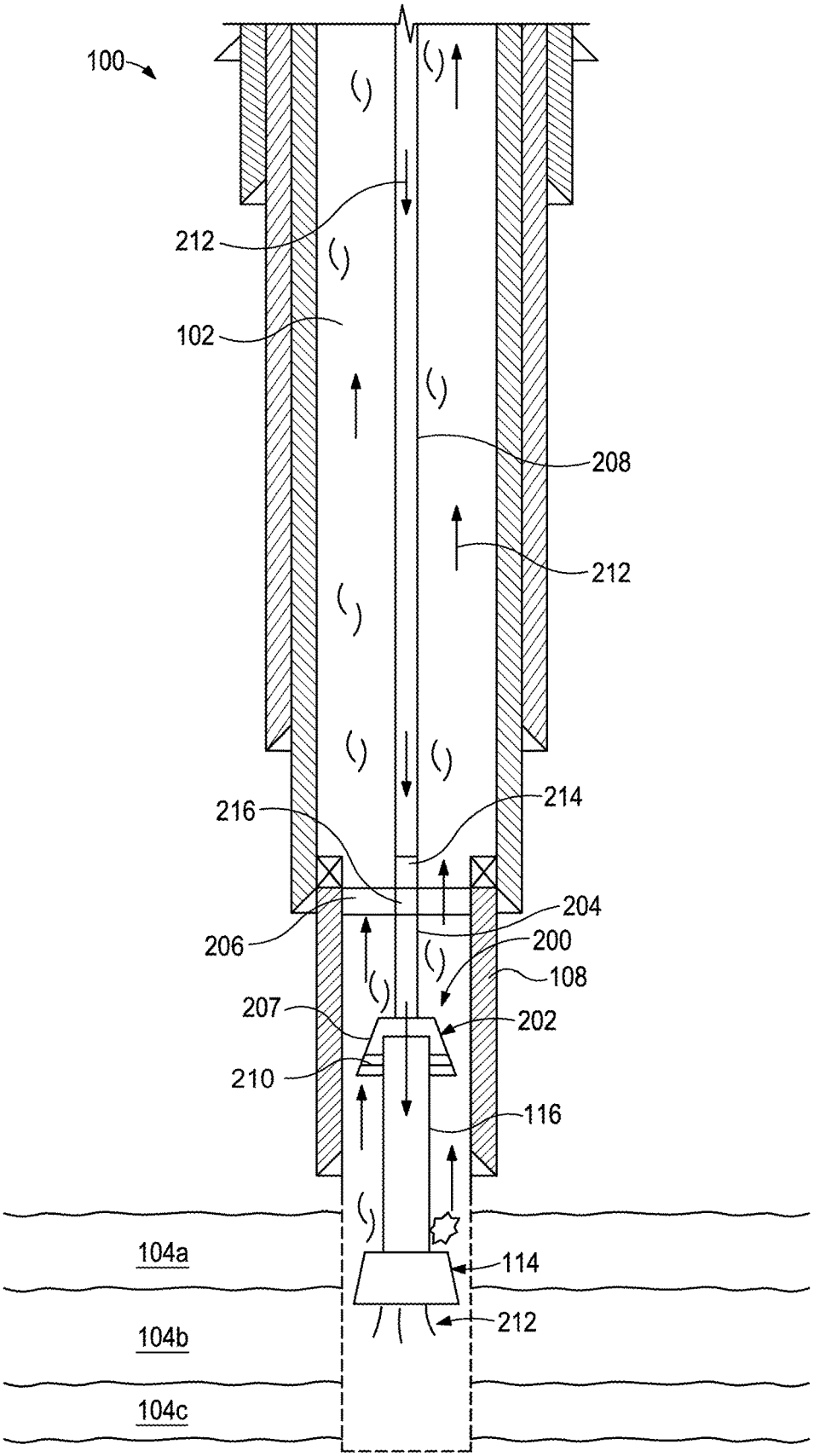
FIG. 2 is another schematic view of the well system of FIG. 1, including a sacrificial tool according to one or more embodiments of the present disclosure.

FIG. 2 is another schematic view of the well system 100, including an example sacrificial tool 200 according to one or more embodiments of the present disclosure. As described herein, the sacrificial tool 200 may be used to undertake a P & A process that isolates the subterranean formations 104*a-c*. As illustrated, the sacrificial tool 200 includes an overshot fishing tool 202, a tubing 204 of a predefined length coupled to the overshot fishing tool 202, and a liner hanger 206 arranged at an upper end of the tubing 204. In some applications, the combination of the overshot fishing tool 202 and the tubing 204 may be referred to or otherwise characterized as a sacrificial overshot on tubing.

The sacrificial tool 200 may be conveyed downhole on a conveyance 208, such as drill pipe or production tubing. Once the sacrificial tool 200 is conveyed to the proper location to locate and engage the downhole tool 114, the liner hanger 206 may be actuated to secure the sacrificial tool 200 within the wellbore 102 and, more particularly, within the liner 108. The sacrificial tool 200 may then be used to perform cement isolation with the downhole tool 114 in place.

The overshot fishing tool 202 may include a cylindrical housing 207 sized to locate and receive an upper (uphole) end of the downhole tool 114 and, more particularly, the downhole tubular 116. The housing 207 may include and otherwise be equipped with one or more seals 210 for sealingly engaging the uphole end of the downhole tubular 116 when received within the housing 207. More specifically, upon receiving the uphole end of the downhole tubular 116 within the overshot fishing tool 202, the seals 210 may sealingly engage the outer surface of the downhole tubular 116, thus placing the sacrificial tool 200 in fluid communication with the downhole tool 114. Consequently, fluids conveyed to and through the tubing 204 to the overshot fishing tool 202 will be conveyed into the downhole tool 114 via the downhole tubular 116.

The sacrificial tool 200 is shown in FIG. 2 engaged with the downhole tool 114. Prior to establishing communication between the sacrificial tool 200 and the downhole tool 114, however, a fluid 212 may be conveyed downhole through the conveyance 208 and circulated through the sacrificial tool 200. The fluid 212 may include, but is not limited to, a drilling fluid (e.g., water-based muds, oil-based muds, etc.), a completion fluid, or any combination thereof. The fluid 212 may be circulated with a predefined (known) pressure to flow through the sacrificial tool 200 and overshot fishing tool 202 discharged into the wellbore 102 via the end of the overshot fishing tool 202 to be returned to the well surface. As the fluid 212 circulates, various measurements may be recorded including, but not limited to, a surface pressure (i.e., fluid pressure of the fluid 212 returning to the well surface), pick up weight, slack off weight, and circulation flow rate. Recording such measurements will provide baseline measurements prior to the sacrificial tool 200 establishing communication with the downhole tool 114, which may help confirm successful subsequent engagement. Moreover, circulating through the sacrificial tool 200 may also ensure that there is no blockage in the sacrificial tool 200 prior to engagement with the downhole tool 114, and to potentially clean any debris from the uphole end of the downhole tool 114.

Once fluid communication between the sacrificial tool 200 and the downhole tool 114 is established, the fluid 212 may continue to be circulated to further establish fluid circulation through the downhole tool 114. The fluid 212 may be transmitted to the downhole tool 114 via the sealed interface between the sacrificial tool 200 and the downhole tool 114. The fluid 212 may be discharged from the downhole tool 114 and into the portion of the wellbore 102 downhole from the downhole tool 114. The fluid 212 may then be able to circulate back uphole within the annulus defined between the downhole tool 114 and the inner walls of the wellbore 102.

To confirm proper engagement (coupling) of the sacrificial tool 200 with the downhole tool 114, and to further confirm circulation through the downhole tool, the surface pressure, the pick-up weight, the slack off weight, and the circulation flow rate may again be measured. If an increase in the surface pressure and the pick-up weight is observed, and a decrease in the slack off weight is observed, that may provide a positive indication (confirmation) that the sacrificial tool 200 is properly engaged with the downhole tool 114 and, more particularly, that the overshot fishing tool 202 is fluidly coupled to the uphole end of the downhole tubular 116.

After confirming that the sacrificial tool 200 is properly coupled to the downhole tool 114, the liner hanger 206 may be activated with the conveyance 208 in tension to secure the sacrificial tool 200 within the liner 108. More particularly, the liner hanger 206 may be conveyed downhole on a running tool 214 coupled to the distal end of the conveyance 208. The tubing 204 may provide and otherwise define a polished bore receptacle 216, and the distal end of the running tool 214 may be configured to be releasably coupled to the sacrificial tool 200 at the polished bore receptacle 216. The running tool 214 may be configured to connect the conveyance 208 (e.g., tubing, drill pipe, etc.) to the liner hanger 206 and the sacrificial tool 200. The running tool 214 may be sized to be received within the polished bore receptacle 216.

The liner hanger 206 may include one or more sets of slips, and activating the liner hanger 206 may include manipulating the running tool 214 via the conveyance 208 to force the slips into gripping engagement with the inner wall of the liner 108. In some embodiments, the liner hanger 206 may be configured to be set using a hydraulically-actuated system. Thereafter, the pick-up weight and the slack off weight of the conveyance 208 may again be recorded to establish a new baseline prior to releasing the running tool 214. If there is a decrease in the pick-up weight and the slack off weight, that may be an indication (confirmation) that the liner hanger 206 is properly set. Accordingly, after hanger slips are set, the pick-up weight should be less than the prior measurement recorded after engagement.

Figure 3:
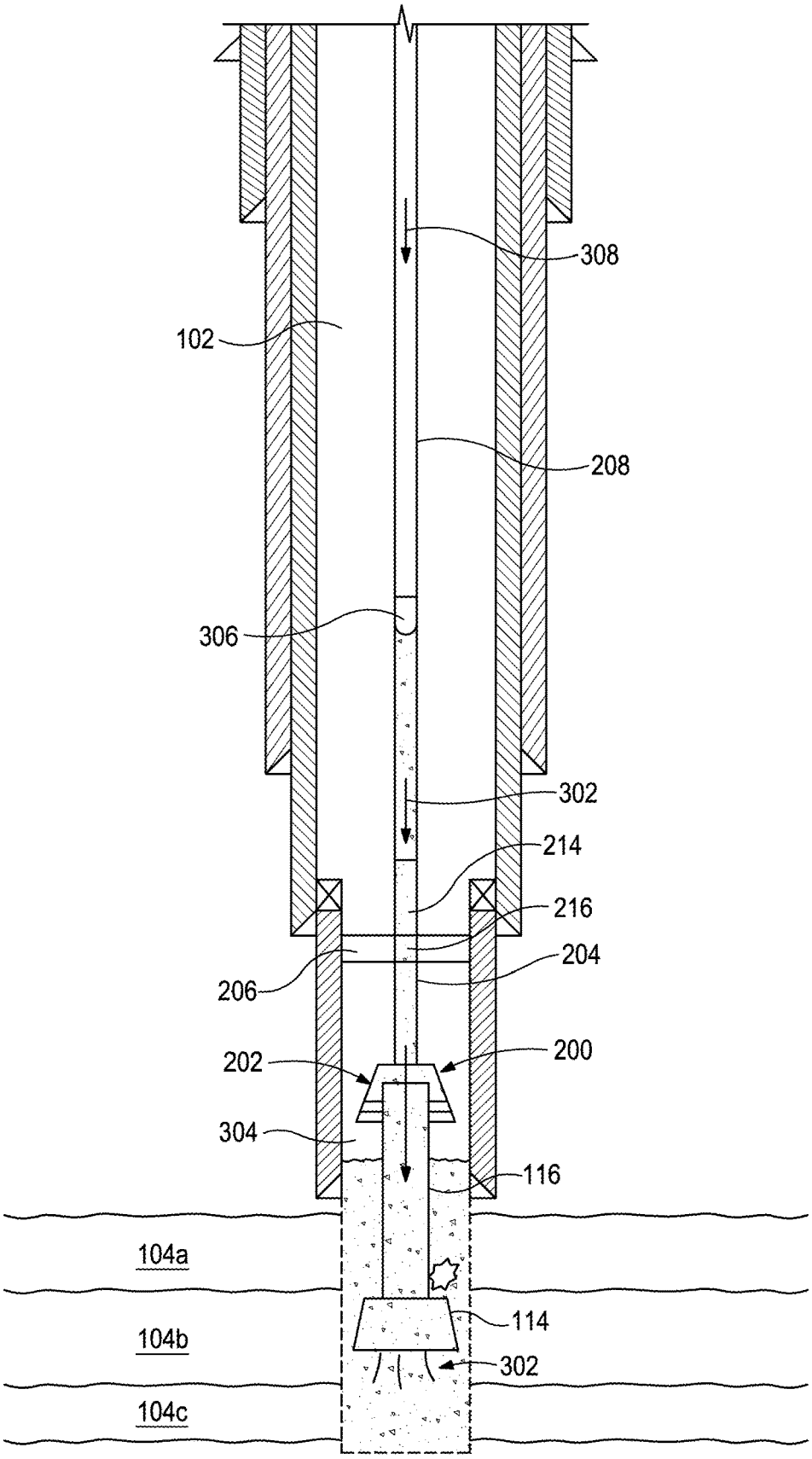
FIGS. 3 and 4 are schematic views of the well system of FIG. 1 showing progressive operational steps in plugging and abandoning a wellbore, according to one or more embodiments of the present disclosure.

FIG. 3 is another schematic view of the well system 100 showing progressive operational steps in plugging and abandoning the wellbore 102, according to one or more embodiments of the present disclosure. After confirming that the liner hanger 206 is properly set, as described above, the running tool 214 may be released (disengaged) from the sacrificial tool 200 without pulling the running tool 214 out of the polished bore receptacle 216 of the tubing 204.

With the running tool 214 disengaged from the sacrificial tool 200, cement 302 may be pumped downhole via the conveyance 208 and to the sacrificial tool 200. The cement 302 may be conveyed into the downhole tool 114 from the sacrificial tool 200 via the sealed engagement between the overshot fishing tool 202 and the uphole end of the downhole tubular 116. The cement 302 may then be discharged from the downhole tool 114 into the wellbore 102 and, more particularly, into an annulus 304 defined between the downhole tool 114 and an inner wall of the wellbore 102. As the cement 302 is continuously pumped into the annulus 304, a column of the cement 302 may begin to form and grow within the annulus 304.

In some embodiments, a wiper plug 306 may be dropped within the conveyance 208 and hydraulically displaced along the conveyance 208 with a fluid 308 (e.g., drilling fluid) pumped from the well surface. As the wiper plug 306 is forced down the conveyance 208, the cement 302 is progressively discharged out of the downhole tool 114 and into the annulus 304. In some embodiments, the wiper plug 306 may be displaced sufficiently down the conveyance 208 and toward the downhole tool 114 to discharge enough cement 302 to reach the location of the liner hanger 206. In at least one embodiment, the column of the cement 302 within the annulus 304 may stop level at the liner hanger 206.

Figure 4:
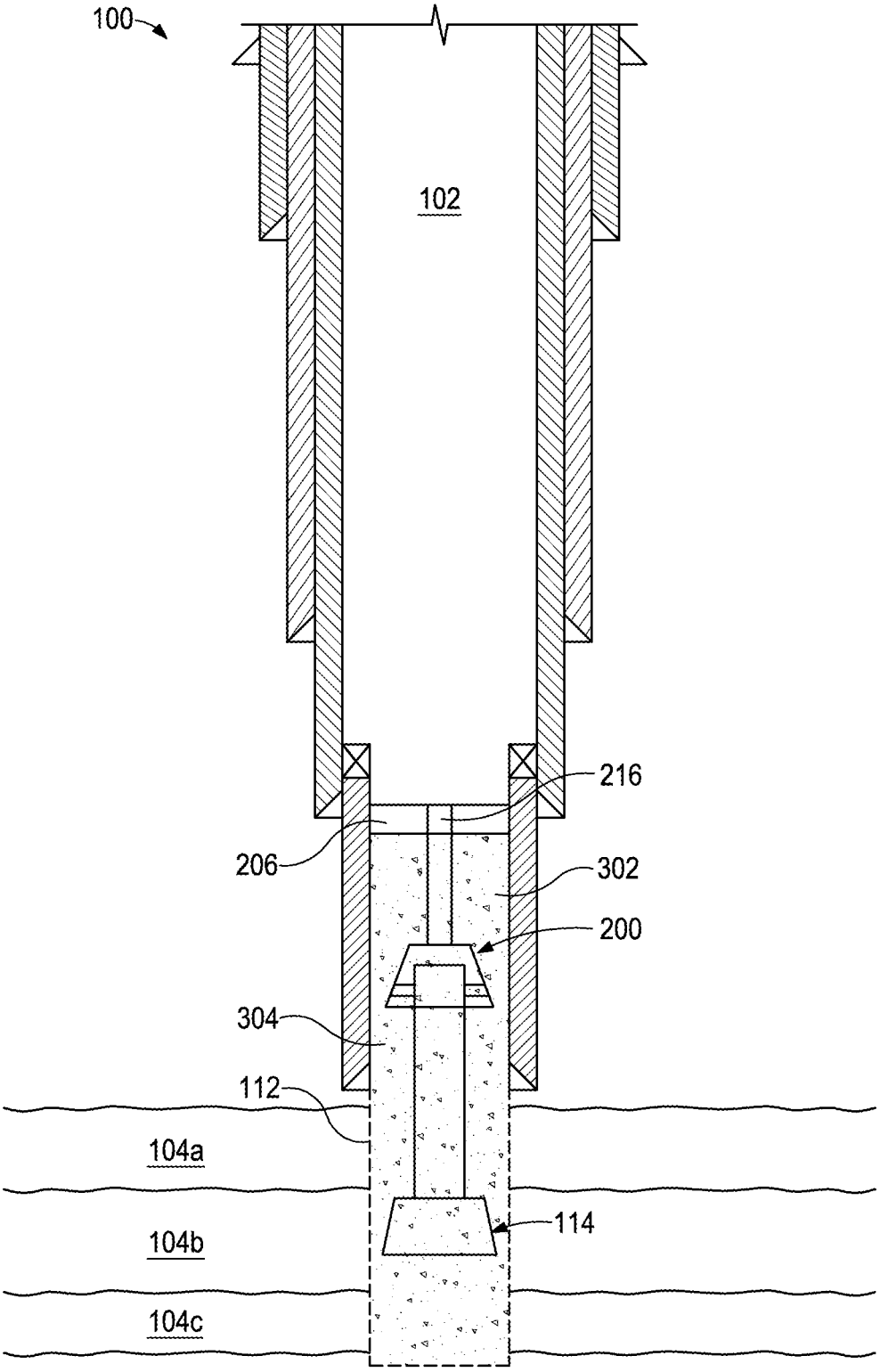

FIG. 4 is another schematic view of the well system 100 showing progressive operational steps in plugging and abandoning the wellbore 102, according to one or more embodiments of the present disclosure. After pumping the cement 302 into the annulus 304, and optionally pumping until the cement 302 reaches the liner hanger 206, the running tool 214 (FIGS. 2 and 3) may be pulled out of the polished bore receptacle 216 to reverse out any excessive cement 302 and in preparation for final pull out of hole (POOH). This reversing process of the cement 302 enables proper isolation of the subterranean formations 104*a-c* while having the ability to release the conveyance 208 (FIGS. 2 and 3).

As illustrated in FIG. 4, the cement 302 has been pumped into the annulus 304 and is allowed to cure with the downhole tool 114 and the sacrificial tool 200 remaining within the wellbore 102. The resulting column of cement 302 spans the subterranean formations 104*a-c*, which ensures isolation of the formations 104*a-c*, but may also enable sidetracking the wellbore 102 instead of expending valuable resources and time attempting to recover the downhole tool 114 or accepting to leave the downhole tool 114 in the open hole 112 with improper cement isolation between the formations 104*a-c*. Once isolation is achieved, sidetracking from a shallow depth can commence. Consequently, less time and money may be expended attempting to retrieve the downhole tool 114 in order to properly plug and abandon the wellbore 102 before sidetrack operation.

Figure 5:
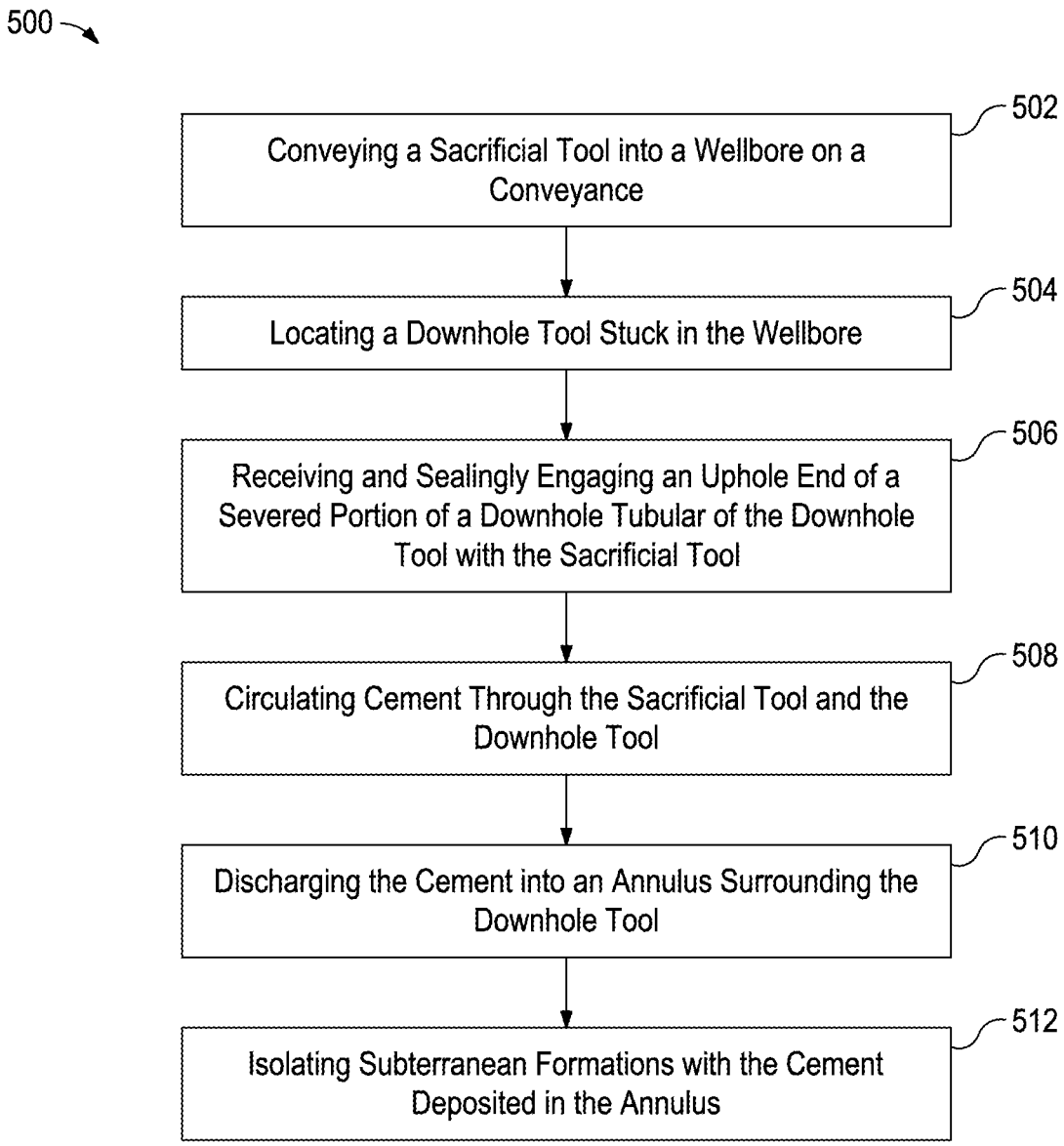
FIG. 5 is a schematic flowchart of an example method of isolating one or more undesired subterranean formations, according to the embodiments described herein

FIG. 5 is a schematic flowchart of an example method 500 of isolating one or more undesired subterranean formations, according to the embodiments described herein. As illustrated, the method 500 may include conveying a sacrificial tool into a wellbore on a conveyance, at step 502. The wellbore may penetrate one or more subterranean formations and the sacrificial tool may include an overshot fishing tool, a tubing operatively coupled to and extending from the overshot fishing tool, and a liner hanger arranged at an upper end of the tubing. The method 500 may further include locating with the sacrificial tool a downhole tool stuck in the wellbore, as at 504. In some embodiments, the downhole tool may be stuck in the wellbore adjacent the one or more subterranean formations. Moreover, the sacrificial tool may be operatively coupled to or form part of a severed portion of a downhole tubular.

The method 500 may further include receiving and sealingly engaging an uphole end of the severed portion of the downhole tubular with the overshot fishing tool, as at 506. A cement may then be circulated through the sacrificial tool and the downhole tool, as at 508, and the cement may be discharged into an annulus defined between the downhole tool and an inner wall of the wellbore, as at 510. In some embodiments, discharging the cement into the annulus will progressively form a column of cement within the annulus that spans the one or more subterranean formations, and thereby isolates the subterranean formations, as at 512.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including." "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method, comprising:

conveying a sacrificial tool into a wellbore coupled to a conveyance after a downhole tool has become stuck in the wellbore, the sacrificial tool including:

an overshot fishing tool;

a tubing operatively coupled to and extending from the overshot fishing tool; and a liner hanger arranged at an upper end of the tubing;

conveying a fluid through the conveyance and to the sacrificial tool prior to receiving an uphole end of the downhole tool within the overshot fishing tool;

discharging the fluid into the wellbore from the overshot fishing tool prior to receiving the uphole end of the downhole tool within the overshot fishing tool;

recording one or more measurements selected from the group consisting of a surface pressure, a pick up weight, a slack off weight, and circulation flow rate prior to receiving the uphole end of the downhole tool within the overshot fishing tool;

receiving the uphole end of the downhole tool within the overshot fishing tool;

sealingly engaging the uphole end of the downhole tool;

conveying the fluid through the sacrificial tool and the downhole tool after sealingly engaging the uphole end of the downhole tool;

discharging the fluid from the downhole tool into the annulus after sealingly engaging the uphole end of the downhole tool;

confirming proper engagement of the sacrificial tool with the downhole tool upon recording an increase in the surface pressure and the pick-up weight, and recording a decrease in the slack off weight after sealingly engaging the uphole end of the downhole tool; and circulating a cement through the sacrificial tool and the downhole tool and discharging the cement into an annulus defined between the downhole tool and an inner wall of the wellbore.

2. The method of claim 1, wherein the downhole tool includes a severed downhole tubular, and wherein receiving the uphole end of the downhole tool comprises receiving an uphole end of the severed downhole tubular.

3. The method of claim 1, further comprising:

activating the liner hanger and thereby securing the sacrificial tool within the wellbore; and confirming that the liner hanger is properly set upon recording a decrease in the pick-up weight and the slack off weight.

4. The method of claim 3, wherein a least a portion of the wellbore is lined with a liner and the liner hanger includes one or more slips, and wherein activating the liner hanger comprises forcing the one or more slips into gripping engagement with an inner surface of the liner.

5. The method of claim 1, wherein the liner hanger includes a running tool received within a polished bore receptacle of the tubing, and wherein circulating the cement through the sacrificial tool and the downhole tool is preceded by releasing the running tool from the sacrificial tool without pulling the running tool out of the polished bore receptacle.

6. The method of claim 1, wherein discharging the cement into the annulus comprises progressively forming a column of cement within the annulus that spans the one or more subterranean formations.

7. The method of claim 6, further comprising ceasing circulation of the cement when the column of cement reaches the liner hanger within the annulus.

8. A method, comprising:

conveying a sacrificial tool coupled to a conveyance into a wellbore penetrating one or more subterranean formations after a downhole tool has become stuck in the wellbore;

conveying a fluid through the conveyance and to the sacrificial tool prior to receiving an uphole end of the downhole tool within the sacrificial tool, and thereby discharging the fluid into the wellbore from the sacrificial tool;

recording one or more measurements selected from the group consisting of a surface pressure, a pick up weight, a slack off weight, and circulation flow rate prior to receiving the uphole end of the downhole tool within the sacrificial tool;

conveying the sacrificial tool through the wellbore to receive the uphole end of the downhole tool within the sacrificial tool in the wellbore, thereby coupling the sacrificial tool to the downhole tool;

sealingly engaging the uphole end of the downhole tool by engaging a seal coupled to an inner surface of the sacrificial tool with an outer surface of the downhole tool;

conveying the fluid through the sacrificial tool and the downhole tool after sealingly engaging the uphole end of the downhole tool;

discharging the fluid from the downhole tool into the annulus after sealingly engaging the uphole end of the downhole tool;

confirming proper engagement of the sacrificial tool with the downhole tool upon recording an increase in the surface pressure and the pick-up weight, and recording a decrease in the slack off weight after sealingly engaging the uphole end of the downhole tool; and pumping cement through the sacrificial tool and the downhole tool coupled thereto into an annulus defined between the downhole tool and an inner wall of the wellbore.

9. The method of claim 8, wherein the sacrificial tool includes an overshot fishing tool and tubing extending from the overshot fishing tool, and wherein coupling the uphole end of the downhole tool to the sacrificial tool in the wellbore comprising coupling the uphole end of the downhole tool to the overshot fishing tool.

10. The method of claim 9, wherein discharging the cement comprises progressively forming a column of cement within the annulus that spans the one or more subterranean formations.

11. The method of claim 10, wherein the sacrificial tool further includes a liner hanger extending from the tubing, and the method further comprises ceasing circulation of the cement based on the column of cement reaching the liner hanger.

12. A method, comprising:

deploying a sacrificial tool into a wellbore on a conveyance after a fish becomes stuck in the wellbore, the sacrificial tool including an overshot fishing tool and a liner hanger;

conveying a fluid through the conveyance and to the sacrificial tool prior to landing the overshot fishing tool on the fish, and thereby discharging the fluid into the wellbore from the overshot fishing tool;

recording one or more measurements selected from the group consisting of a surface pressure, a pick up weight, a slack off weight, and circulation flow rate prior to landing the overshot fishing tool on the fish;

landing the overshot fishing tool on the fish stuck in the wellbore by receiving an uphole end of the fish within the overshot fishing tool;

sealingly engaging the uphole end of the fish by engaging one or more seals of the overshot fishing tool with an outer surface of the uphole end of the fish;

conveying the fluid through the sacrificial tool and the fish after sealingly engaging the uphole end of the fish;

discharging the fluid from the fish into the annulus after sealingly engaging the uphole end of the fish;

confirming proper engagement of the sacrificial tool with the fish upon recording an increase in the surface pressure and the pick-up weight, and recording a decrease in the slack off weight after sealingly engaging the uphole end of the fish;

setting the liner hanger after landing the overshot fishing tool on the fish; and circulating a cement through the sacrificial tool and the fish to form a cement plug below the set liner hanger, thereby cementing the fish and the overshot fishing tool within the wellbore and plugging a first portion of the wellbore downhole of the cement plug from a second portion of the wellbore uphole of the cement plug.

13. The method of claim 12, further comprising:

disengaging the sacrificial tool from a running tool prior to circulating the cement; and retrieving the running tool to the surface.

14. The method of claim 12, wherein the cement plug is at least partially formed in a bore of a casing disposed in the wellbore, wherein the cement plug blocks flow through the bore of the casing.

15. The method of claim 14, wherein the cement plug is partially disposed in an open hole section of the wellbore downhole of the casing.

* * * * *